US010944244B2

(12) United States Patent
Ban et al.

(10) Patent No.: US 10,944,244 B2
(45) Date of Patent: Mar. 9, 2021

(54) SPARK PLUG

(71) Applicant: NGK SPARK PLUG CO., LTD., Nagoya (JP)

(72) Inventors: Kenji Ban, Nagoya (JP); Tatsuya Gozawa, Nagoya (JP)

(73) Assignee: NGK SPARK PLUG CO., LTD., Nagoya (JP)

( * ) Notice: Subject to any disclaimer, the term of this patent is extended or adjusted under 35 U.S.C. 154(b) by 0 days.

(21) Appl. No.: 16/815,390

(22) Filed: Mar. 11, 2020

(65) Prior Publication Data

US 2020/0295540 A1 Sep. 17, 2020

(30) Foreign Application Priority Data

Mar. 15, 2019 (JP) ..... JP2019-047985

(51) Int. Cl.

| | |
|---|---|
| ***H01T 13/06*** | (2006.01) |
| ***H01T 13/32*** | (2006.01) |
| ***H01T 21/02*** | (2006.01) |
| ***H01T 13/39*** | (2006.01) |

(52) U.S. Cl.

CPC ..... *H01T 13/32* (2013.01); *H01T 13/06* (2013.01); *H01T 13/39* (2013.01); *H01T 21/02* (2013.01)

(58) Field of Classification Search

CPC ..... H01T 13/06
USPC ..... 313/141
See application file for complete search history.

(56) References Cited

U.S. PATENT DOCUMENTS

| | | | | |
|---|---|---|---|---|
| 2,292,409 | A * | 8/1942 | Steward | F02B 19/1004 123/275 |
| 4,930,473 | A * | 6/1990 | Dietrich | F02B 19/12 123/169 EL |
| 2011/0148274 | A1* | 6/2011 | Ernst | H01T 13/467 313/141 |
| 2011/0297121 | A1* | 12/2011 | Kraus | H01T 13/50 123/260 |
| 2011/0308489 | A1* | 12/2011 | Herden | F02B 19/18 123/143 B |
| 2012/0125287 | A1* | 5/2012 | Chiera | F02B 19/16 123/254 |
| 2016/0053670 | A1* | 2/2016 | Tozzi | F02B 19/18 123/260 |
| 2016/0276810 | A1* | 9/2016 | Chiera | F02B 19/12 |
| 2019/0288488 | A1* | 9/2019 | Niessner | H01T 13/28 |

FOREIGN PATENT DOCUMENTS

JP 2017-103179 6/2017

* cited by examiner

*Primary Examiner* — Christopher M Raabe
(74) *Attorney, Agent, or Firm* — Kusner & Jaffe

(57) ABSTRACT

A spark plug includes a plug cap having a plurality of through holes. In a cross section including an axial line, the plug cap includes an enlarging portion in a portion of a region between a first imaginary straight line and a second imaginary straight line, the first imaginary straight line extending through a front end of the end portion of a ground electrode and being perpendicular to the axial line, the second imaginary straight line extending through a back end of one of inner open ends of the through holes that is closest to a front end of the spark plug and being perpendicular to the axial line. The enlarging portion being a portion in which a minimum distance from an outer surface to an inner surface of the plug cap increases with increasing distance in a direction from back to front.

5 Claims, 5 Drawing Sheets

SPARK PLUG

FIELD OF THE INVENTION

The present invention relates to a spark plug including a pre-chamber for a combustion chamber of an engine.

BACKGROUND OF THE INVENTION

A spark plug including a pre-chamber for a combustion chamber of an engine is known. For example, see Japanese Unexamined Patent Application Publication No. 2017-103179 ("PTL 1"). This type of spark plug includes a plug cap that has through holes and that is connected to a front end portion of a metal shell. The spark plug ignites combustible air-fuel mixture that has flowed into the plug cap from the combustion chamber through the through holes. The air-fuel mixture is combusted to generate an expansion pressure that causes a gas flow including flame to be injected into the combustion chamber through the through holes, so that the combustible air-fuel mixture in the combustion chamber is rapidly combusted due to the injected jet flow.

According to the technology described in PTL 1, the plug cap has a substantially constant wall thickness from the back end to the front end thereof. Therefore, a front end portion of the plug cap is easily cooled, and the thermal energy of the gas flow including flame is easily transferred to the plug cap. This causes a reduction in the energy of the jet flow injected into the combustion chamber through the through holes, resulting in a reduction in the rate of combustion in the combustion chamber or misfiring. Thus, combustion stability is reduced.

SUMMARY OF THE INVENTION

The present invention has been made to solve the above-described problem, and an object of the present invention is to provide a spark plug with which stable combustion can be achieved.

To achieve the above-described object, a spark plug according to the present invention includes a metal shell having a tubular shape and extending along an axial line in a direction from front to back; a center electrode retained in the metal shell in an insulated manner; a ground electrode electrically connected to the metal shell and disposed such that a spark gap is formed between the center electrode and an end portion of the ground electrode; and a plug cap connected to a front end portion of the metal shell, the plug cap covering the center electrode and the end portion of the ground electrode from the front and having a plurality of through holes in a region in front of the ground electrode. In a cross section including the axial line, the plug cap includes an enlarging portion in at least a portion of a region between a first imaginary straight line and a second imaginary straight line, the first imaginary straight line extending through a front end of the end portion of the ground electrode and being perpendicular to the axial line, the second imaginary straight line extending through a back end of one of inner open ends of the through holes that is closest to a front end of the spark plug and being perpendicular to the axial line, the enlarging portion being a portion in which a minimum distance from an outer surface to an inner surface of the plug cap increases with increasing distance in a direction from back to front. A cross-sectional area of a region surrounded by the enlarging portion along a plane perpendicular to the axial line decreases with increasing distance in the direction from back to front.

According to a spark plug of a first aspect, the enlarging portion is provided between the front end of the end portion of the ground electrode and the back end of one of the inner open ends of the through holes in the plug cap that is closest to the front end of the spark plug, the enlarging portion being a portion in which the minimum distance from the outer surface to the inner surface of the plug cap increases with increasing distance in the direction from back to front. Heat conduction through the enlarging portion toward the back becomes more difficult with increasing distance in the direction from front to back, and heat capacity of the enlarging portion increases with increasing distance in the direction from back to front. Therefore, the temperature in a front region of the enlarging portion is not excessively reduced. As a result, the jet flow injected into the combustion chamber has sufficient thermal energy.

In addition, the cross-sectional area of the region surrounded by the enlarging portion along a plane perpendicular to the axial line decreases with increasing distance in the direction from back to front. Therefore, the speed of the gas flow in a front region of the enlarging portion can be increased. Accordingly, the jet flow injected into the combustion chamber has sufficient kinetic energy. Since the jet flow has sufficient thermal energy and sufficient kinetic energy, stable combustion of combustible air-fuel mixture can be achieved in the combustion chamber.

According to a spark plug of a second aspect, in the cross section including the axial line, a line showing an inner surface of the enlarging portion has a substantially constant radius of curvature. Accordingly, protrusions are not easily formed on the inner surface of the enlarging portion. As a result, overheating of the inner surface of the enlarging portion at the protrusions can be prevented. Thus, not only can the effects of the first aspect be obtained, but combustible air-fuel mixture that has flowed into the plug cap from the combustion chamber through the through holes can be prevented from undergoing pre-ignition with protrusions on the inner surface of the enlarging portion serving as ignition sources.

According to a spark plug of a third aspect, in the cross section including the axial line, the minimum distance from the outer surface to the inner surface of the plug cap is smallest at a front end of the inner surface of the plug cap. In this case, the heat capacity of a portion including the front end of the inner surface of the plug cap is less than the heat capacity of a portion including the front end of the enlarging portion. Accordingly, the temperature of the portion including the front end of the inner surface of the plug cap can be easily reduced. Thus, not only can the effects of the first and second aspects be obtained, but the combustible air-fuel mixture that has flowed into the plug cap from the combustion chamber through the through holes can be prevented from undergoing pre-ignition with the front end of the inner surface of the plug cap serving as an ignition source.

According to a spark plug of a fourth aspect, in the cross section including the axial line, the minimum distance from the outer surface to the inner surface of the plug cap is smallest at a front end of the outer surface of the plug cap. In this case, the heat capacity of the portion including the front end of the inner surface of the plug cap can be reduced in a region including the front end of the outer surface. Accordingly, the temperature of the portion including the front end of the outer surface of the plug cap can be easily reduced. Thus, not only can the effects of the third aspect be obtained, but the combustible air-fuel mixture in the combustion chamber can be prevented from undergoing pre-ignition with the front end of the outer surface of the plug cap serving as an ignition source.

According to a spark plug of a fifth aspect, a front end of the outer surface of the plug cap is a flat surface. In this case, overheating of the front end of the outer surface of the plug cap can be reduced. Therefore, not only can the effects of the first to fourth aspects be obtained, but the combustible air-fuel mixture in the combustion chamber can be prevented from undergoing pre-ignition with the front end of the outer surface of the plug cap serving as an ignition source.

According to a spark plug of a sixth aspect, the plug cap includes a straight portion formed between the enlarging portion and back ends of the plurality of through holes. A cross-sectional area of a region surrounded by the straight portion along a plane perpendicular to the axial line is constant over entire length of the straight portion in a direction of the axial line. Accordingly, the gas flow can be accelerated with less loss in the gas flow in the straight portion. Since the jet flow injected into the combustion chamber has sufficient kinetic energy, not only can the effects of the first to fifth aspects be obtained, but stable combustion of the combustible air-fuel mixture can be achieved in the combustion chamber.

DETAILED DESCRIPTION OF THE INVENTION

Figure 1:
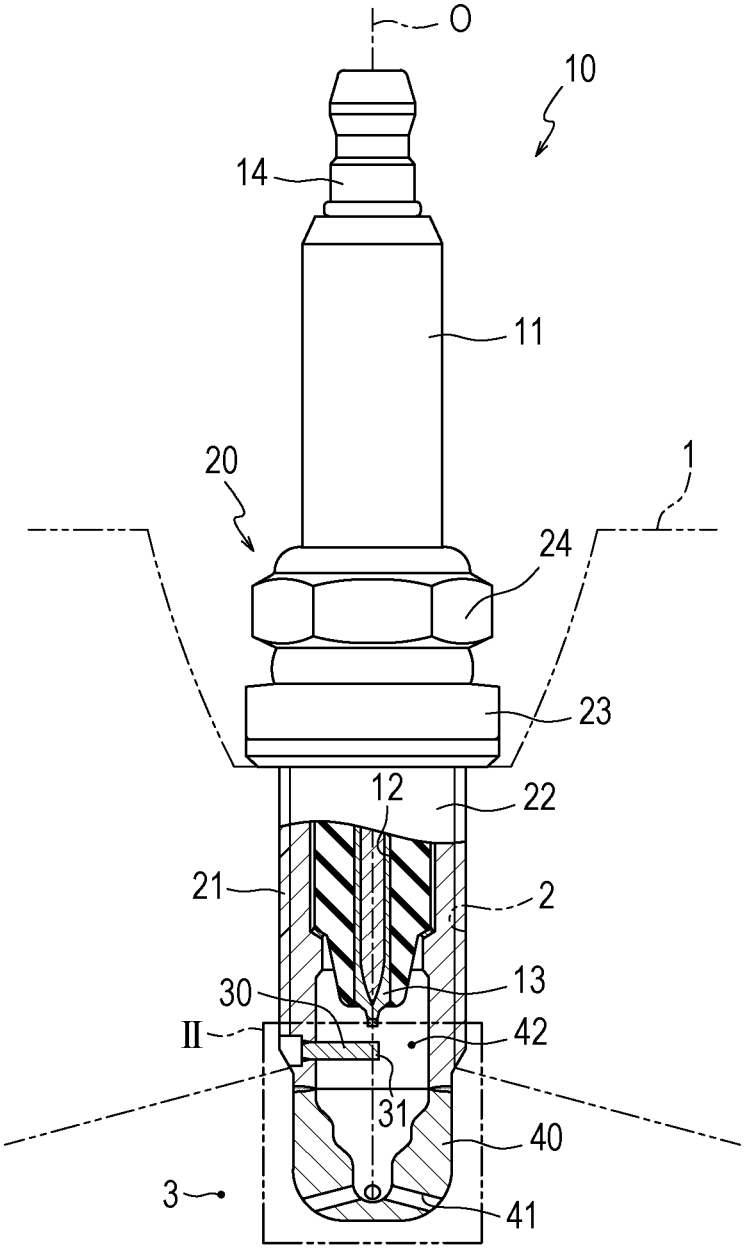
FIG. 1 is a partially sectioned view of a spark plug according to a first embodiment.

Preferred embodiments of the present invention will now be described with reference to the accompanying drawings. FIG. 1 is a partially sectioned view of a spark plug 10 according to a first embodiment. The bottom of FIG. 1 is defined as the front of the spark plug 10, and the top of FIG. 1 is defined as the back of the spark plug 10. This also applies to FIGS. 2 to 5. FIG. 1 shows a cross section of a front end portion of the spark plug 10 including an axial line O. As illustrated in FIG. 1, the spark plug 10 includes an insulator 11, a center electrode 13, a metal shell 20, a ground electrode 30, and a plug cap 40.

The insulator 11 is a substantially cylindrical member having an axial hole 12 that extends along the axial line O, and is made of a ceramic, such as alumina, having good mechanical characteristics and high insulation properties at high temperatures. The center electrode 13 is disposed in a front region of the axial hole 12 in the insulator 11. The center electrode 13 is electrically connected to a metal terminal 14 in the axial hole 12. The metal terminal 14 is a rod-shaped member to which a high-voltage cable (not shown) is connected, and is made of a conductive metal material (for example, low-carbon steel). The metal terminal 14 is fixed to the back end of the insulator 11.

The metal shell 20 is a substantially cylindrical member made of a conductive metal material (for example, low-carbon steel). The metal shell 20 includes a front end portion 22 having an external thread 21 formed on an outer peripheral surface thereof, a seating portion 23 that is adjacent to the back end of the front end portion 22, and a tool engagement portion 24 provided behind the seating portion 23. The external thread 21 is screwed into a threaded hole 2 in an engine 1. The seating portion 23 is a portion that seals a clearance between the threaded hole 2 in the engine 1 and the external thread 21, and has an outer diameter greater than the outer diameter of the external thread 21. The tool engagement portion 24 engages with a tool, such as a wrench, used to screw the external thread 21 into the threaded hole 2 in the engine 1.

The ground electrode 30 is a rod-shaped member made of a metal material containing, for example, Ni as a main component. In the present embodiment, the ground electrode 30 is disposed at a position where the external thread 21 is provided, and extends through the front end portion 22 to project into the inside of the front end portion 22. The ground electrode 30 includes an end portion 31 that faces the center electrode 13. The plug cap 40 is connected to the front end portion 22 of the metal shell 20.

The plug cap 40 is a portion that covers the center electrode 13 and the end portion 31 of the ground electrode 30 from the front. The plug cap 40 is made of a metal material containing, for example, Ni as a main component. The plug cap 40 has a plurality of through holes 41 in a region in front of the ground electrode 30. When the spark plug 10 is installed by screwing the external thread 21 into the threaded hole 2 in the engine 1, the plug cap 40 is exposed in the combustion chamber 3 of the engine 1. The through holes 41 connect a pre-chamber 42 in the plug cap 40 to the combustion chamber 3.

Figure 2:
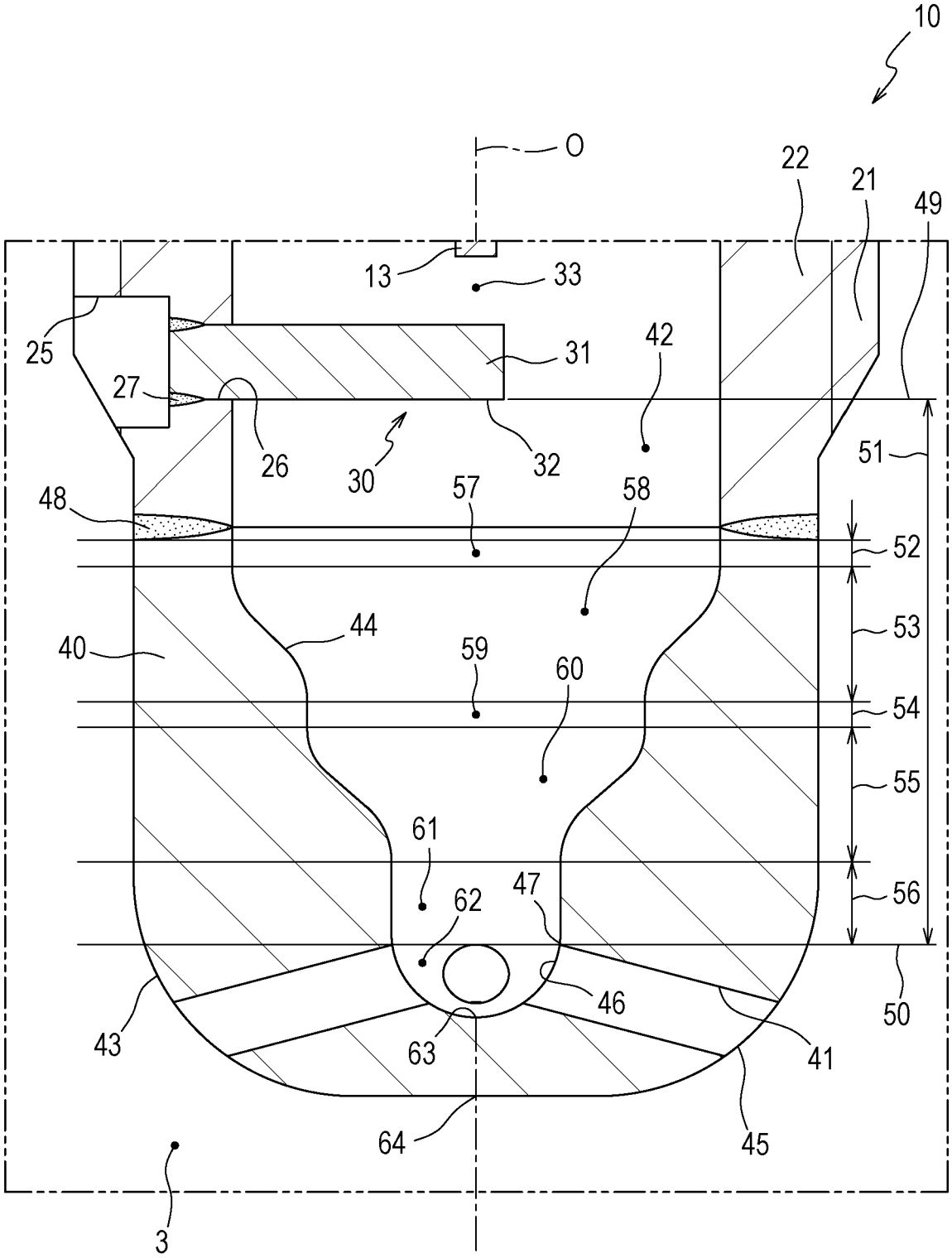
FIG. 2 is an enlarged sectional view of part II of the spark plug shown in FIG. 1.

FIG. 2 is an enlarged sectional view of part II of the spark plug 10 shown in FIG. 1 including the axial line O. The front end portion 22 of the metal shell 20 has a recess 25 that is recessed radially inward in a region where the external thread 21 is provided. The front end portion 22 also has a hole 26, which is thinner than the recess 25, in a region radially inside the recess 25. The hole 26 extends through the front end portion 22 in a radial direction. The ground electrode 30 is inserted through the hole 26 and joined to the front end portion 22 by a melted portion 27. A spark gap 33 is formed between the end portion 31 of the ground electrode 30 and the center electrode 13. Since the ground electrode 30 is joined to the metal shell 20 in the region where the external thread 21 is provided, heat is transferred from the ground electrode 30 to the engine 1 through the external thread 21.

The plug cap 40 has an outer surface 43 that is sphere-cap-shaped and an inner surface 44 that is cone-shaped. The through holes 41 have outer open ends 45 in the outer surface 43 of the plug cap 40 and inner open ends 46 in the inner surface 44 of the plug cap 40. Each through hole 41 is inclined toward the front in the direction from the inner open end 46 to the outer open end 45 thereof. In the present embodiment, back ends 47 of the inner open ends 46 of the through holes 41 are all positioned on a plane perpendicular to the axial line O. The plug cap 40 is joined to the front end portion 22 of the metal shell 20 by a melted portion 48.

In a cross section including the axial line O, the plug cap 40 includes a first enlarging portion 53 and a second enlarging portion 55 in a region 51 between a first imaginary straight line 49 and a second imaginary straight line 50. The first imaginary straight line 49 extends through a front end 32 of the end portion 31 of the ground electrode 30 and is perpendicular to the axial line O. The second imaginary straight line 50 extends through the back end 47 of one of the inner open ends 46 that is closest to the front end of the spark plug 10 and is perpendicular to the axial line O. The second enlarging portion 55 is located in front of the first enlarging portion 53. The first enlarging portion 53 and the second enlarging portion 55 are each a portion in which the minimum distance from the outer surface 43 to the inner surface 44 of the plug cap 40 increases with increasing distance in the direction from back to front. The minimum distance from the outer surface 43 to the inner surface 44 of the plug cap 40 is the length of the shortest line segment between a point on the outer surface 43 and a point on the inner surface 44 in the region 51.

The plug cap 40 includes a first straight portion 52, a second straight portion 54, and a third straight portion 56 in addition to the first enlarging portion 53 and the second enlarging portion 55 in the region 51. The first straight portion 52, the first enlarging portion 53, the second straight portion 54, the second enlarging portion 55, and the third straight portion 56 are arranged in that order in the direction from back to front. The front end of the melted portion 48 is in contact with the first straight portion 52.

The first enlarging portion 53 is adjacent to the front end of the first straight portion 52, and the second straight portion 54 is adjacent to the front end of the first enlarging portion 53. The second enlarging portion 55 is adjacent to the front end of the second straight portion 54, and the third straight portion 56 is adjacent to the front end of the second enlarging portion 55. The back ends 47 of the inner open ends 46 are in contact with the third straight portion 56.

The cross-sectional area of a first inner region 57, which is a region surrounded by the first straight portion 52, along a plane perpendicular to the axial line O is constant over the entire length of the first straight portion 52 in an axial line direction. The cross-sectional area of the first inner region 57 along a plane perpendicular to the axial line O is equal to the cross-sectional area of the pre-chamber 42 along a plane perpendicular to the axial line O at the front end 32 of the end portion 31 of the ground electrode 30.

The cross-sectional area of a second inner region 58, which is a region surrounded by the first enlarging portion 53, along a plane perpendicular to the axial line O decreases with increasing distance in the direction from back to front. The cross-sectional area of a third inner region 59, which is a region surrounded by the second straight portion 54, along a plane perpendicular to the axial line O is constant over the entire length of the second straight portion 54 in the axial line direction. The cross-sectional area of a fourth inner region 60, which is a region surrounded by the second enlarging portion 55, along a plane perpendicular to the axial line O decreases with increasing distance in the direction from back to front. The cross-sectional area of a fifth inner region 61, which is a region surrounded by the third straight portion 56, along a plane perpendicular to the axial line O is constant over the entire length of the third straight portion 56 in the axial line direction.

A front end region 62, which is a region in front of the fifth inner region 61 in the pre-chamber 42, includes a front end 63 of the inner surface 44 of the plug cap 40. The cross-sectional area of the front end region 62 along a plane perpendicular to the axial line O at the back end of the front end region 62 is smaller than the cross-sectional area of the first enlarging portion 53 along a plane perpendicular to the axial line O at the back end of the first enlarging portion 53. The front end 63 of the inner surface 44 is a portion of a sphere-cap-shaped curved surface. The front end 63 of the inner surface 44 is spaced from the inner open ends 46 of the through holes 41. The front end 63 of the inner surface 44 is located on the axial line O. The minimum distance from the outer surface 43 to the inner surface 44 of the plug cap 40 is smallest at the front end 63 of the inner surface 44. In particular, in the present embodiment, the minimum distance from the outer surface 43 to the inner surface 44 of the plug cap 40 is smallest between a front end 64 of the outer surface 43 of the plug cap 40 and the front end 63 of the inner surface 44 of the plug cap 40. The front end 64 of the outer surface 43 is a flat surface that is perpendicular to the axial line O.

The spark plug 10 generates a discharge in the spark gap 33 to ignite combustible air-fuel mixture that has flowed into the plug cap 40 from the combustion chamber 3 through the through holes 41. The air-fuel mixture is combusted to generate an expansion pressure that causes a gas flow including flame to be injected into the combustion chamber 3 through the through holes 41, so that the combustible air-fuel mixture in the combustion chamber 3 is combusted due to the injected jet flow.

The spark plug 10 is configured such that the first enlarging portion 53 and the second enlarging portion 55 are provided in the region 51 between the front end 32 of the end portion 31 of the ground electrode 30 and the back end 47 of one of the inner open ends 46 of the through holes 41 in the plug cap 40 that is closest to the front end of the spark plug 10. The first enlarging portion 53 and the second enlarging portion 55 are each a portion in which the minimum distance from the outer surface 43 to the inner surface 44 of the plug cap 40 in a cross section including the axial line O increases with increasing distance in the direction from back to front. Heat conduction through the first enlarging portion 53 and the second enlarging portion 55 toward the back becomes more difficult with increasing distance in the direction from front to back, and the heat capacities of the first enlarging portion 53 and the second enlarging portion 55 increase with increasing distance in the direction from back to front. Therefore, the temperature in a front region of the second enlarging portion 55 is not excessively reduced when, for example, load on the engine 1 is low. Accordingly, the jet flow injected into the combustion chamber 3 has sufficient thermal energy.

The cross-sectional area of each of the second inner region 58 surrounded by the first enlarging portion 53 and the fourth inner region 60 surrounded by the second enlarging portion 55 along a plane perpendicular to the axial line O decreases with increasing distance in the direction from back to front. Therefore, the speed of the gas flow including flame in the front region of the second enlarging portion 55 can be increased. Accordingly, the jet flow injected into the combustion chamber 3 has sufficient kinetic energy. As a result, owing to the high-energy jet flow, reduction in the rate of combustion in the combustion chamber 3 and misfiring can be prevented, and the combustible air-fuel mixture in the combustion chamber 3 can be rapidly combusted.

Since the second straight portion 54 is provided between the first enlarging portion 53 and the second enlarging portion 55, the inclination of the inner surface 44 of the plug cap 40 with respect to the axial line O varies in a cross section including the axial line O. Therefore, a turbulent flow can be easily generated in the pre-chamber 42. Accordingly, the rate of combustion in the pre-chamber 42 can be increased.

The spark plug 10 is configured such that, in a cross section including the axial line O, the minimum distance from the outer surface 43 to the inner surface 44 of the plug cap 40 is smallest at the front end 63 of the inner surface 44 of the plug cap 40. Therefore, the heat capacity of a portion including the front end 63 of the inner surface 44 of the plug cap 40 is less than the heat capacities of portions including the front ends of the first enlarging portion 53 and the second enlarging portion 55. Accordingly, the temperature of the portion including the front end 63 of the inner surface 44 of the plug cap 40 can be easily reduced by, for example, radiation. Therefore, when, for example, load on the engine 1 is high, the combustible air-fuel mixture that has flowed into the plug cap 40 from the combustion chamber 3 through the through holes 41 can be prevented from undergoing pre-ignition with the front end 63 of the inner surface 44 of the plug cap 40 serving as an ignition source.

The spark plug 10 is configured such that, in a cross section including the axial line O, the minimum distance from the outer surface 43 to the inner surface 44 of the plug cap 40 is smallest at the front end 64 of the outer surface 43 of the plug cap 40. Therefore, the heat capacity of the portion including the front end 63 of the inner surface 44 of the plug cap 40 can be reduced in a region including the front end 64 of the outer surface 43. Accordingly, the temperature of the portion including the front end 64 of the outer surface 43 of the plug cap 40 can be easily reduced by, for example, radiation. Therefore, when, for example, load on the engine 1 is high, the combustible air-fuel mixture in the combustion chamber 3 can be prevented from undergoing pre-ignition with the front end 64 of the outer surface 43 of the plug cap 40 serving as an ignition source.

The spark plug 10 is configured such that the front end 64 of the outer surface 43 of the plug cap 40 is a flat surface. Accordingly, compared to when the outer surface 43 has a thinned front end, such as a sphere-cap-shaped front end, overheating of the front end 64 of the outer surface 43 of the plug cap 40 can be reduced. Therefore, when, for example, load on the engine 1 is high, the combustible air-fuel mixture in the combustion chamber 3 can be prevented from undergoing pre-ignition with the front end 64 of the outer surface 43 of the plug cap 40 serving as an ignition source.

The plug cap 40 includes the third straight portion 56 formed between the second enlarging portion 55 and the back ends 47 of the through holes 41. Since the cross-sectional area of the fifth inner region 61 surrounded by the third straight portion 56 along a plane perpendicular to the axial line O is constant over the entire length of the third straight portion 56 in the axial line direction, the gas flow can be accelerated with less loss in the gas flow in the third straight portion 56. As a result, the jet flow injected into the combustion chamber 3 has sufficient kinetic energy, so that stable combustion of the combustible air-fuel mixture can be achieved in the combustion chamber 3.

Figure 3:
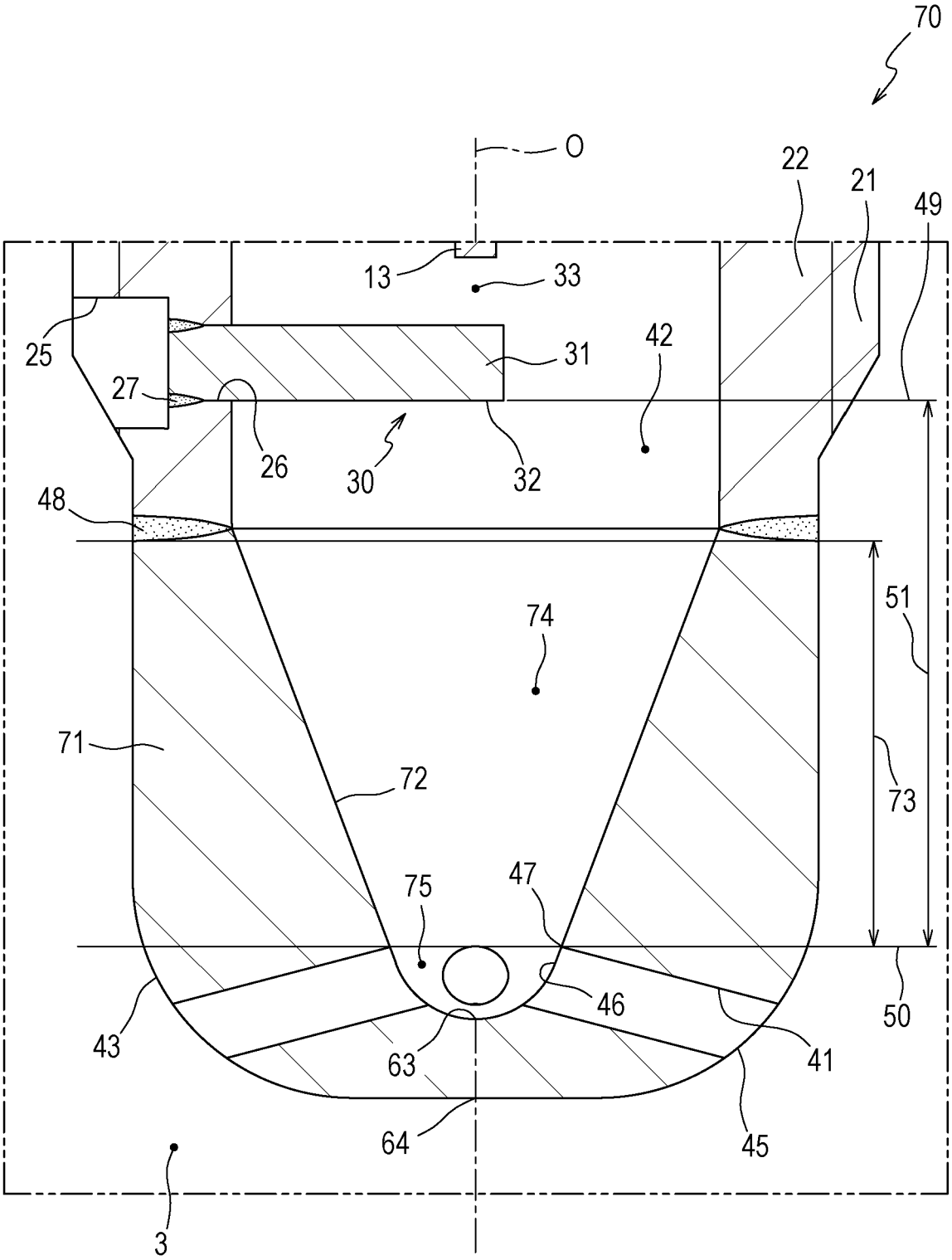
FIG. 3 is a sectional view of a spark plug according to a second embodiment.

A second embodiment will be described with reference to FIG. 3. In the first embodiment, the plug cap 40 includes a plurality of enlarging portions (first enlarging portion 53 and second enlarging portion 55). In contrast, in the second embodiment, a plug cap 71 includes one enlarging portion 73. Components that are the same as those described in the first embodiment are denoted by the same reference signs, and description thereof is omitted. FIG. 3 is a sectional view of a spark plug 70 according to the second embodiment including the axial line O. Similar to the first embodiment, FIG. 3 is an enlarged view of part II (see FIG. 1) of the spark plug 70. This also applies to FIGS. 4 and 5.

The plug cap 71 of the spark plug 70 is joined to the front end portion 22 of the metal shell 20 by the melted portion 48. The plug cap 71 has the outer open ends 45 of the through holes 41 in the outer surface 43 thereof and the inner open ends 46 of the through holes 41 in an inner surface 72 thereof.

The plug cap 71 includes the enlarging portion 73 in the region 51. The enlarging portion 73 is formed such that the minimum distance from the outer surface 43 to the inner surface 72 of the plug cap 71 in a cross section including the axial line O increases with increasing distance in the direction from back to front. The front end of the melted portion 48 is in contact with the enlarging portion 73. The back ends 47 of the inner open ends 46 are in contact with the enlarging portion 73. The cross-sectional area of an inner region 74, which is a region surrounded by the enlarging portion 73, along a plane perpendicular to the axial line O decreases with increasing distance in the direction from back to front. A front end region 75, which is a region in front of the inner region 74 in the pre-chamber 42, includes the front end 63 of the inner surface 72 of the plug cap 71.

In a cross section including the axial line O, a line showing the inner surface 72 of the enlarging portion 73 has a substantially constant radius of curvature. Since the inner surface 72 of the enlarging portion 73 has no significant inflection points, protrusions are not easily formed on the inner surface 72 of the enlarging portion 73. As a result, overheating of the inner surface 72 of the enlarging portion 73 at protrusions can be prevented, so that the combustible air-fuel mixture that has flowed into the plug cap 71 from the combustion chamber 3 through the through holes 41 can be prevented from undergoing pre-ignition with protrusions on the inner surface 72 of the enlarging portion 73 serving as ignition sources. Preferably, the line showing the inner surface 72 of the enlarging portion 73 in a cross section including the axial line O has an exactly constant radius of curvature over the entire length of the enlarging portion 73 in the axial line direction.

Figure 4:
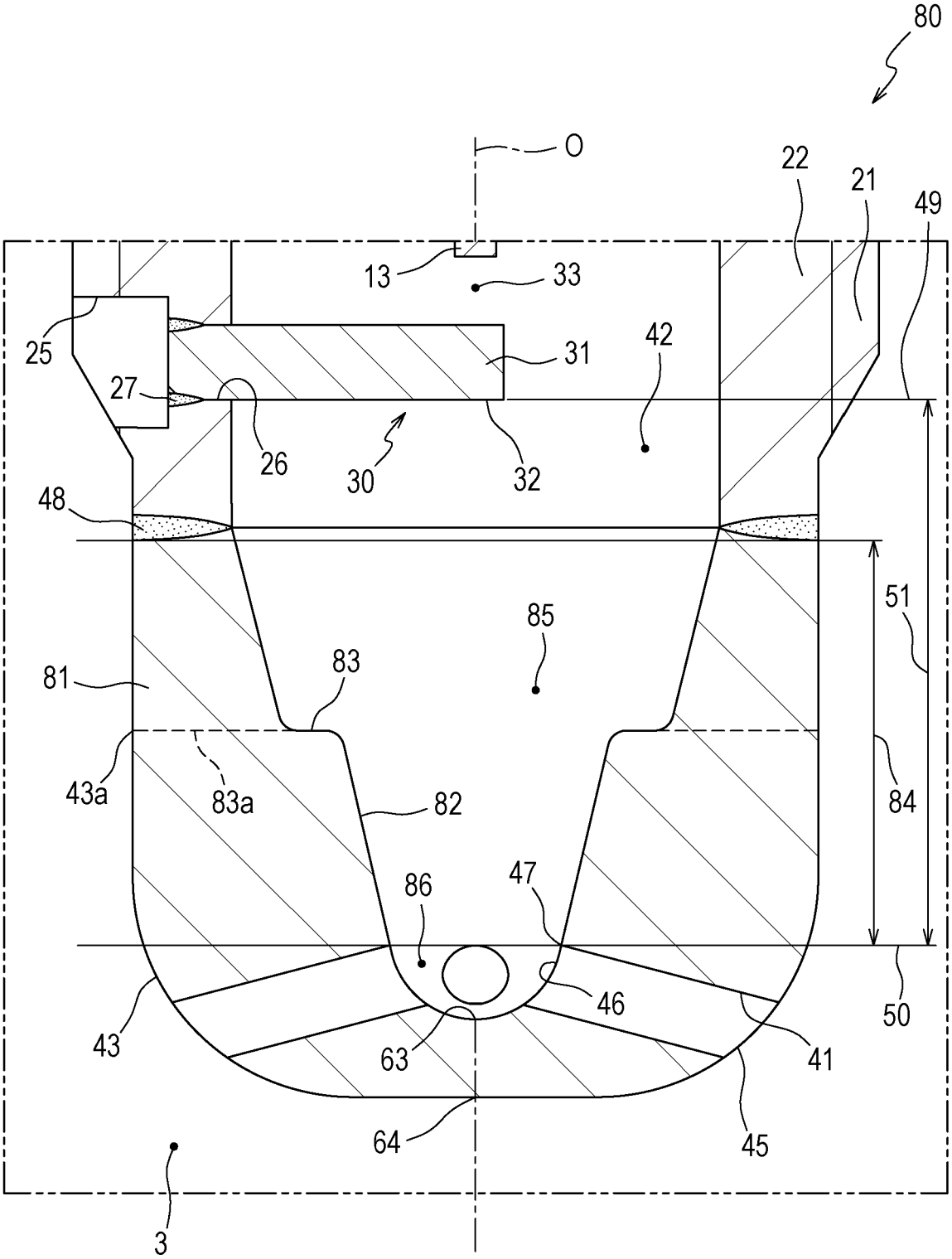
FIG. 4 is a sectional view of a spark plug according to a third embodiment.

A third embodiment will be described with reference to FIG. 4. In the first embodiment, the plug cap 40 includes the second straight portion 54 between the first enlarging portion 53 and the second enlarging portion 55. In contrast, in the third embodiment, a plug cap 81 includes an enlarging portion 84 having a perpendicular surface 83 that is perpendicular to the axial line O. Components that are the same as those described in the first embodiment are denoted by the same reference signs, and description thereof is omitted. FIG. 4 is a sectional view of a spark plug 80 according to the third embodiment including the axial line O.

The plug cap 81 of the spark plug 80 is joined to the front end portion 22 of the metal shell 20 by the melted portion 48. The plug cap 81 has an inner surface 82 including the perpendicular surface 83, which has an annular shape and is perpendicular to the axial line O. The plug cap 81 has the outer open ends 45 of the through holes 41 in the outer surface 43 thereof and the inner open ends 46 of the through holes 41 in the inner surface 82 thereof.

The plug cap 81 includes the enlarging portion 84 in the region 51. The front end of the melted portion 48 is in contact with the enlarging portion 84. The back ends 47 of the inner open ends 46 are in contact with the enlarging portion 84. The cross-sectional area of an inner region 85, which is a region surrounded by the enlarging portion 84, along a plane perpendicular to the axial line O decreases with increasing distance in the direction from back to front. A front end region 86, which is a region in front of the inner region 85 in the pre-chamber 42, includes the front end 63 of the inner surface 82 of the plug cap 81.

The enlarging portion 84 has the perpendicular surface 83. In a cross section including the axial line O, the minimum distance from an intersection point 43*a* between a straight line 83*a* including the perpendicular surface 83 and the outer surface 43 to a point on the perpendicular surface 83 (portion of the inner surface 82) increases with increasing distance in a radially inward direction of the perpendicular surface 83. The enlarging portion 84 is formed such that the minimum distance between a point on the outer surface 43 in a region in front of the intersection point 43*a* and the inner surface 82 is greater than the minimum distance between a point on the outer surface 43 in a region behind the intersection point 43*a* and the inner surface 82. Thus, the enlarging portion 84 is formed such that the minimum distance from the outer surface 43 to the inner surface 82 of the plug cap 81 increases with increasing distance in the direction from back to front.

Since the spark plug 80 according to the third embodiment includes the enlarging portion 84, effects similar to those of the spark plug 10 according to the first embodiment, which includes the first enlarging portion 53 and the second enlarging portion 55, can be obtained. In addition, since the enlarging portion 84 has the perpendicular surface 83, a turbulent flow can be easily generated in the pre-chamber 42. As a result, the rate of combustion in the pre-chamber 42 can be increased.

Figure 5:
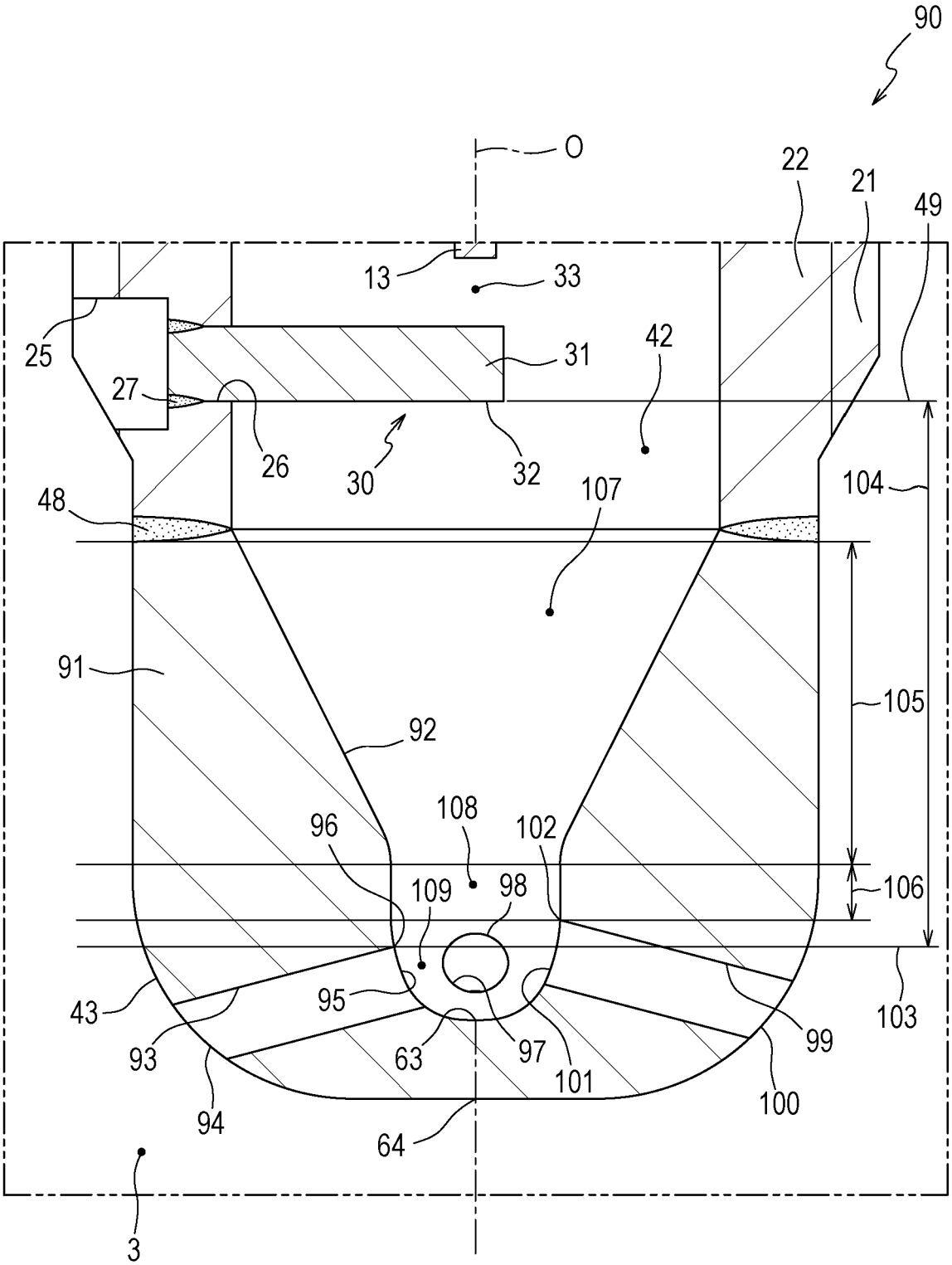
FIG. 5 is a sectional view of a spark plug according to a fourth embodiment.

A fourth embodiment will be described with reference to FIG. 5. In the first to third embodiments, the through holes 41 formed in the plug caps 40, 71, and 81 are at the same position in the axial line direction. In contrast, in the fourth embodiment, a plurality of through holes 93, 97, and 99 are provided at different positions in the axial line direction. Components that are the same as those described in the first embodiment are denoted by the same reference signs, and description thereof is omitted. FIG. 5 is a sectional view of a spark plug 90 according to the fourth embodiment.

The spark plug 90 includes a plug cap 91 joined to the front end portion 22 of the metal shell 20 by the melted portion 48. The plug cap 91 has the plurality of through holes 93, 97, 99. The through hole 93 has an outer open end 94 in the outer surface 43 of the plug cap 91 and an inner open end 95 in an inner surface 92 of the plug cap 91. The through hole 97 has an inner open end 98 in the inner surface 92. The through hole 99 has an outer open end 100 in the outer surface 43 and an inner open end 101 in the inner surface 92. The inner open end 95 is closest to the front end of the spark plug 90, and the inner open end 101 is closest to the back end of the spark plug 90. The through holes 93, 97, and 99 are inclined toward the front in the direction from the inner surface 92 to the outer surface 43 of the plug cap 91.

In a cross section including the axial line O, the plug cap 91 includes an enlarging portion 105 in a region 104 between a first imaginary straight line 49 and a second imaginary straight line 103. The first imaginary straight line 49 extends through the front end 32 of the end portion 31 of the ground electrode 30 and is perpendicular to the axial line O. The second imaginary straight line 103 extends through a back end 96 of the inner open end 95, which is closest to the front end of the spark plug 90, and is perpendicular to the axial line O. The enlarging portion 105 is formed such that the minimum distance from the outer surface 43 to the inner surface 92 of the plug cap 91 increases with increasing distance in the direction from back to front. The cross-sectional area of a first inner region 107, which is a region surrounded by the enlarging portion 105, along a plane perpendicular to the axial line O decreases with increasing distance in the direction from back to front.

A straight portion 106 is provided adjacent to the front end of the enlarging portion 105. The straight portion 106 is in contact with a back end 102 of the inner open end 101 of the through hole 99, which is one of the through holes 93, 97, and 99 that is closest to the back end of the spark plug 90. The cross-sectional area of a second inner region 108, which is a region surrounded by the straight portion 106, along a plane perpendicular to the axial line O is constant over the entire length of the straight portion 106 in the axial line direction. A front end region 109, which is a region in front of the second inner region 108 in the pre-chamber 42, includes the front end 63 of the inner surface 92 of the plug cap 91.

Since the spark plug 90 according to the fourth embodiment includes the enlarging portion 105 and the straight portion 106, effects similar to those of the spark plug 10 according to the first embodiment, which includes the second enlarging portion 55 and the third straight portion 56, can be obtained. In addition, since the inner surface 92 of the enlarging portion 105 includes radially inwardly convex inflection points near the straight portion 106 in a cross section including the axial line O, a turbulent flow can be easily generated in the pre-chamber 42. As a result, the rate of combustion in the pre-chamber 42 can be increased.

Although the present invention has been described based on embodiments, the present invention is not limited to the above-described embodiments in any way, and it can be easily understood that various improvements and modifications are possible within the spirit of the present invention. For example, the shapes of the plug caps 40, 71, 81, and 91 and the number, shapes, sizes, etc., of the through holes 41, 93, 97, and 99 may be set as appropriate.

Although the plug caps 40, 71, 81, and 91 are each welded to the metal shell 20 in the embodiments, the plug caps are not necessarily limited to this. For example, a plug cap may, of course, be a front end portion of a tubular member having a closed front end and connected to the front end portion 22 of the metal shell 20. The tubular member is disposed to surround the outer periphery of the front end portion 22 of the metal shell 20. An external thread formed on the outer peripheral surface of the tubular member is screwed into the threaded hole 2 in the engine 1.

The tubular member (plug cap) may be connected to the front end portion 22 of the metal shell 20 by, for example, forming an internal thread on an inner peripheral surface of the tubular member and screwing the internal thread onto the external thread 21 formed on the front end portion 22. Alternatively, a back end portion of the tubular member and the seating portion 23 of the metal shell 20 may be joined together by, for example, welding. Alternatively, a flange may be formed on the back end portion of the tubular member, and the seating portion 23 of the metal shell 20 and the flange may be joined together by, for example, welding. The tubular member may be made of, for example, a metal material such as a nickel-based alloy or a ceramic such as silicon nitride.

Although the ground electrode 30 that extends through the front end portion 22 of the metal shell 20 is disposed at a position where the external thread 21 is provided in the embodiments, the position of the ground electrode is not necessarily limited to this. For example, the plug cap may be disposed such that the front end surface of the front end portion 22 of the metal shell 20 is exposed, and the ground electrode may, of course, be connected to the front end surface of the front end portion 22. The ground electrode may have either a straight shape or a bent shape. The ground electrode may be joined to the plug cap.

Although the inner open ends 46, 95, 98, and 101 of the through holes 41, 93, 97, and 99 appear in cross sections of the plug caps 40, 71, 81, and 91 along a plane including the axial line O in the embodiments, the through holes are not necessarily limited to this. The through holes may, of course, be formed in the plug caps 40, 71, 81, and 91 such that positions of the inner open ends thereof relative to the axial line O are shifted so that the inner open ends do not appear in cross sections along a plane including the axial line O. In such a case, the positions of the inner open ends of the through holes can be determined based on the inner open ends that appear in cross sections of the plug caps 40, 71, 81, and 91 along a plane parallel to the axial line O. The regions 51 and 104 in cross sections along a plane including the axial line O are determined based on the determined positions of the inner open ends of the through holes. The minimum distances from the outer surfaces 43 to the inner surfaces 44, 72, 82, and 92 of the plug caps 40, 71, 81, and 91 are measured in the cross sections along a plane including the axial line O.

Although the front end 64 of the outer surface 43 of each of the plug caps 40, 71, 81, and 91 is a flat surface in the embodiments, the front end 64 is not necessarily limited to this. The front end 64 of the outer surface 43 of each of the plug caps 40, 71, 81, and 91 may, of course, instead be sphere-cap-shaped or cone-shaped.

Although the front end 63 of each of the inner surfaces 44, 72, 82, and 92 of the plug caps 40, 71, 81, and 91 is a portion of a curved surface in the embodiments, the front end 63 is not necessarily limited to this. The front end 63 of each of the inner surfaces 44, 72, 82, and 92 of the plug caps 40, 71, 81, and 91 may, of course, instead be a flat surface.

Although the front ends 63 of the inner surfaces 44, 72, 82, and 92 of the plug caps 40, 71, 81, and 91 are spaced from the front ends of the inner open ends 46, 95, 98, and 101 of the through holes 41, 93, 97, and 99 in the embodiments, the plug caps are not necessarily limited to this. The front ends of the inner open ends 46, 95, 98, and 101 of the through holes 41, 93, 97, and 99 may instead be in contact with the front ends 63 of the inner surfaces 44, 72, 82, and 92.

Although the front ends of the inner open ends 46 and 95 of the through holes 41 and 93 formed in the plug caps 40, 71, 81, and 91 are positioned behind the front ends 63 of the inner surfaces 44, 72, 82, and 92 of the plug caps 40, 71, 81, and 91 in the embodiments, the positions of the front ends of the inner open ends 46 and 95 are not necessarily limited to this. The positions of the front ends of the inner open ends 46 and 95 may, of course, instead be the same as the positions of the front ends 63 of the inner surfaces 44, 72, 82, and 92 in the axial line direction. In this case, the gas flow in the pre-chamber 42 is smoothly introduced into the through holes 41 and 93.

In the fourth embodiment, the lines showing the inner surface 92 of the enlarging portion 105 in a cross section including the axial line O include radially inwardly convex inflection points. However, the enlarging portion 105 is not necessarily limited to this. For example, the lines showing the inner surface 92 of the enlarging portion 105 may, of course, have radially outwardly convex inflection points at positions behind the radially inwardly convex inflection points. Also in other embodiments, the inner surfaces of the enlarging portions may, of course, have radially outwardly convex inflection points.

Each embodiment may be modified by providing one or more portions of the structures of other embodiments in addition to the structure thereof or in place of one or more portions of the structure thereof or by omitting a portion of the structure thereof.

For example, in the first embodiment, the first straight portion 52 may, of course, be omitted and the first enlarging portion 53 may be extended toward the back so that the first enlarging portion 53 is in contact with the melted portion 48. Also, in the first embodiment, the second straight portion 54 may, of course, be omitted so that the first enlarging portion 53 and the second enlarging portion 55 are connected to each other. Also, in the first embodiment, the third straight portion 56 may, of course, be omitted and the second enlarging portion 55 may be extended toward the front so that the second enlarging portion 55 is in contact with the back ends 47 of the inner open ends 46. Also, in the first embodiment, one of the first enlarging portion 53 and the second enlarging portion 55 may, of course, be omitted or an additional enlarging portion may, of course, be provided.

In addition, in the third embodiment, a straight portion may, of course, be provided between the enlarging portion 84 and the back ends 47 of the inner open ends 46. Also, in the third embodiment, a plurality of perpendicular surfaces 83 may, of course, be provided at different positions in the axial line direction.

What is claimed is:

1. A spark plug comprising:

a metal shell having a tubular shape and extending along an axial line in a direction from front to back, the metal shell including a front end portion having an external thread on an outer peripheral surface of the metal shell;

a center electrode retained in the metal shell in an insulated manner;

a ground electrode electrically connected to the metal shell and disposed such that a spark gap is formed between the center electrode and an end portion of the ground electrode; and a plug cap connected to the front end portion of the metal shell at a position that is closer to a position of a tip of the front end portion of the metal shell than the external thread of the front end portion of the metal shell, the plug cap covering the center electrode and the end portion of the ground electrode from the front and having a plurality of through holes in a region in front of the ground electrode, wherein, in a cross section including the axial line, the plug cap includes an enlarging portion in at least a portion of a region between a first imaginary straight line and a second imaginary straight line, the first imaginary straight line extending through a front end of the end portion of the ground electrode and being perpendicular to the axial line, the second imaginary straight line extending through a back end of one of inner open ends of the plurality of through holes that is closest to a front end of the spark plug and being perpendicular to the axial line, the enlarging portion being a portion in which a minimum distance from an outer surface to an inner surface of the plug cap increases with increasing distance in a direction from back to front, wherein a cross-sectional area of a region surrounded by the enlarging portion along a plane perpendicular to the axial line decreases with increasing distance in the direction from back to front, wherein the plug cap is joined to the front end portion of the metal shell by a melted portion, and wherein the enlarging portion extends from the melted portion to the back end of one of inner open ends of the plurality of through holes.

2. The spark plug according to claim 1, wherein, in the cross section including the axial line, a line showing an inner surface of the enlarging portion has a substantially constant radius of curvature.

3. The spark plug according to claim 1, wherein, in the cross section including the axial line, the minimum distance is smallest at a front end of the inner surface of the plug cap.

4. The spark plug according to claim 3, wherein, in the cross section including the axial line, the minimum distance is smallest at a front end of the outer surface of the plug cap.

5. The spark plug according to claim 1, wherein a front end of the outer surface of the plug cap is a flat surface.

* * * * *